US005351996A

United States Patent [19]

Martin

[11] Patent Number: 5,351,996

[45] Date of Patent: Oct. 4, 1994

[54] PLUMBING SYSTEM WITH CONNECTOR BETWEEN A FLEXIBLE PIPE CONDUIT LAID UNDERNEATH PLASTER AND A FITTING TO BE ARRANGED OUTSIDE THE PLASTER

[75] Inventor: Kurt Martin, Sissach, Switzerland

[73] Assignee: R. Nussbaum AG., Olten, Switzerland

[21] Appl. No.: 994,366

[22] Filed: Dec. 21, 1992

[30] Foreign Application Priority Data

Mar. 13, 1992 [CH] Switzerland ..... 00847/92
Oct. 12, 1992 [EP] European Pat. Off. ..... 92810773.9

[51] Int. Cl.[5] ..... F16L 35/00; F16L 55/00

[52] U.S. Cl. ..... 285/64; 285/903; 285/179

[58] Field of Search ..... 285/46, 64, 179, 903

[56] References Cited

U.S. PATENT DOCUMENTS

| | | | |
|---|---|---|---|
| 2,131,165 | 9/1938 | Clements | 247/9 |
| 4,307,901 | 12/1981 | Orberg et al. | 285/64 |
| 5,031,940 | 7/1991 | Stefanos | 285/64 |

FOREIGN PATENT DOCUMENTS

| | | | |
|---|---|---|---|
| 0191309 | 8/1986 | European Pat. Off. . | |
| 0085329 | 9/1986 | European Pat. Off. . | |
| 0354177 | 2/1990 | European Pat. Off. . | |
| 7927117 | 9/1979 | Fed. Rep. of Germany . | |
| 3504127 | 9/1985 | Fed. Rep. of Germany | 285/64 |
| 3907337 | 9/1990 | Fed. Rep. of Germany . | |
| 69885 | 3/1991 | Japan | 285/46 |
| 20618 | 1/1992 | Japan | 285/64 |
| 20619 | 1/1992 | Japan | 285/46 |
| 131579 | 5/1992 | Japan | 285/64 |
| 650823 | 8/1985 | Switzerland . | |
| 663814 | 1/1988 | Switzerland . | |
| 2230069 | 10/1990 | United Kingdom . | |

*Primary Examiner*—Eric K. Nicholson
*Attorney, Agent, or Firm*—Brady, O'Boyle & Gates

[57] ABSTRACT

A device serving as a coupling between a flexible pipe conduit (1) installed underneath plaster and a fitting arranged above the plaster comprises a casing (4, 5*a*, 5*b*, 6) and a pipe elbow (3) insertable in the casing (4, 5*a*, 5*b*, 6) and fixable therein. The casing is fashioned so that the pipe elbow can be connected to the pipe conduit (1) in two different ways. In one type of mounting, the inner pipe (1) is bent out of the wall, the pipe elbow (3) is attached thereto, and the entire arrangement is then placed into the casing (4). In the second type, the pipe conduit is connected to the pipe elbow (3) which latter is inserted in the casing head (4) and attached therein. The casing neck consists of two half shells (5*a*, 5*b*) encompassing the clamping ring closure (10) projecting in the downward direction from the casing head (4), as well as a section of the pipe conduit (1). The casing neck fixedly clamps the outer pipe (2) in place and thereby prevents slipping out of this outer pipe.

28 Claims, 11 Drawing Sheets

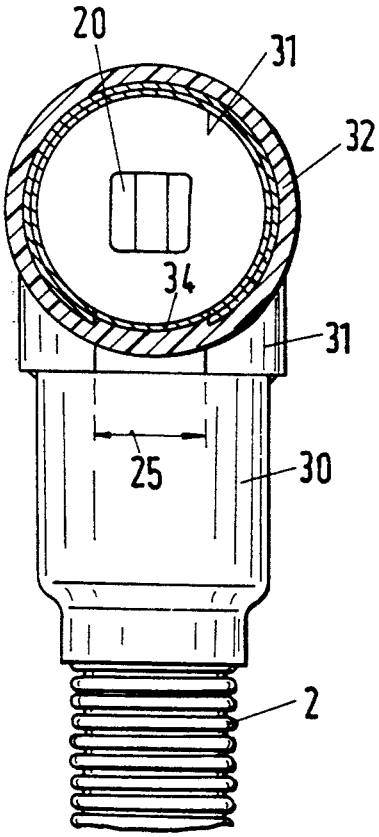
Fig.4a
(B-B)
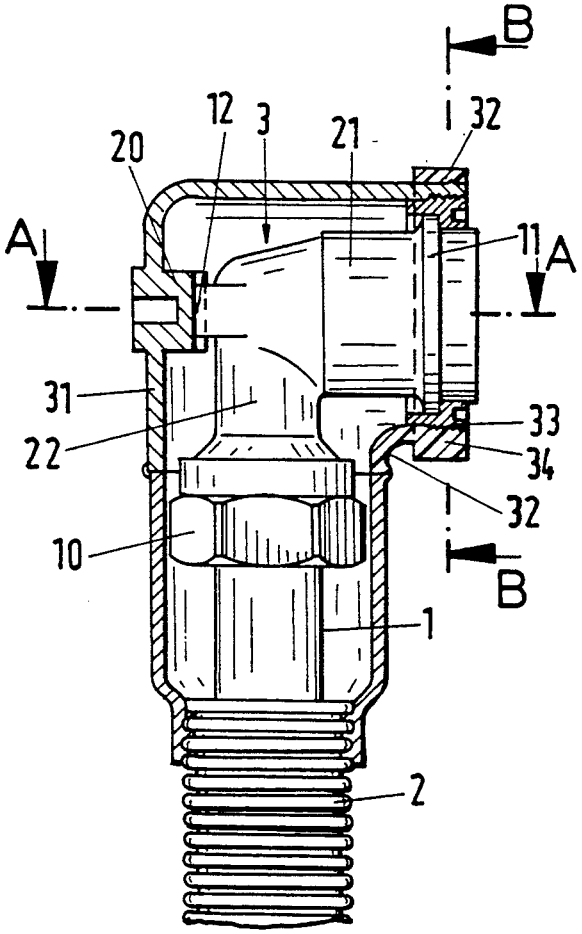
Fig.4b
Fig.4c
(A-A)
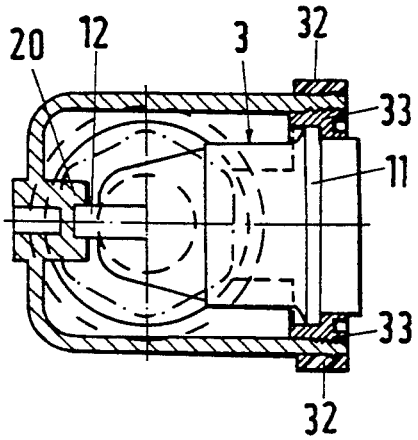

Fig.5a
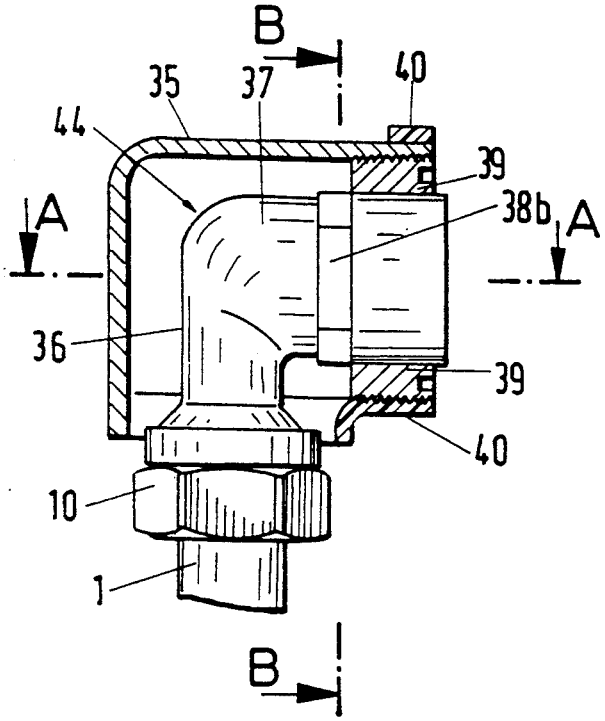
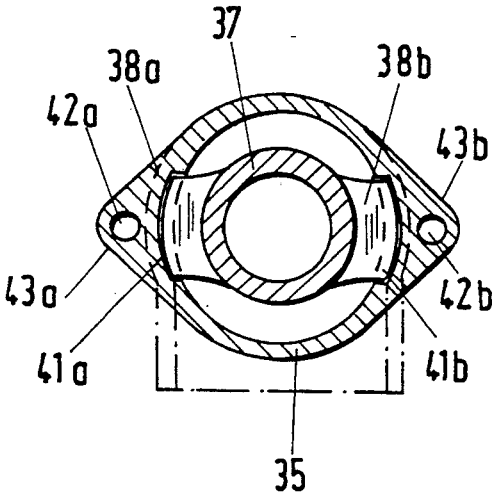
Fig.5b
(B-B)
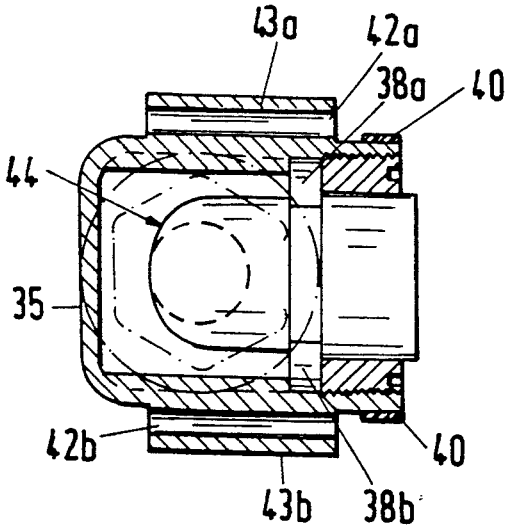
Fig.5c
(A-A)

Fig.6a
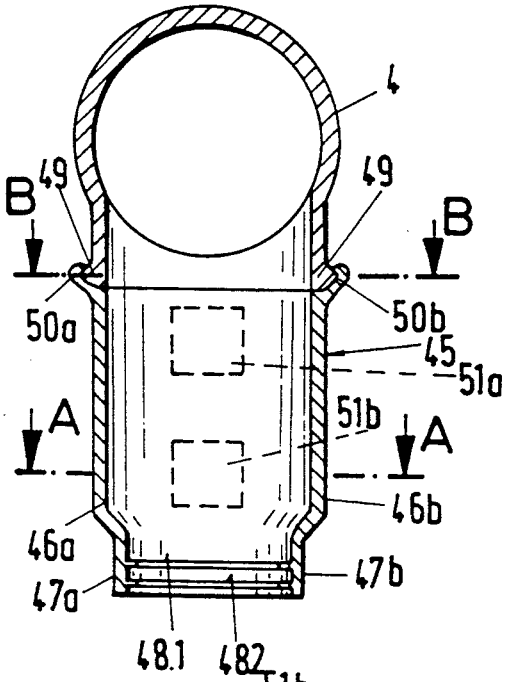
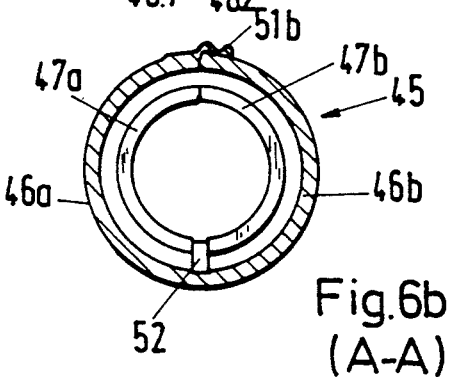
Fig.6b
(A-A)
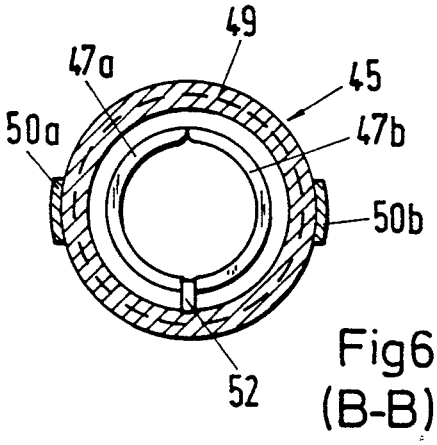
Fig6c
(B-B)
Fig.6d
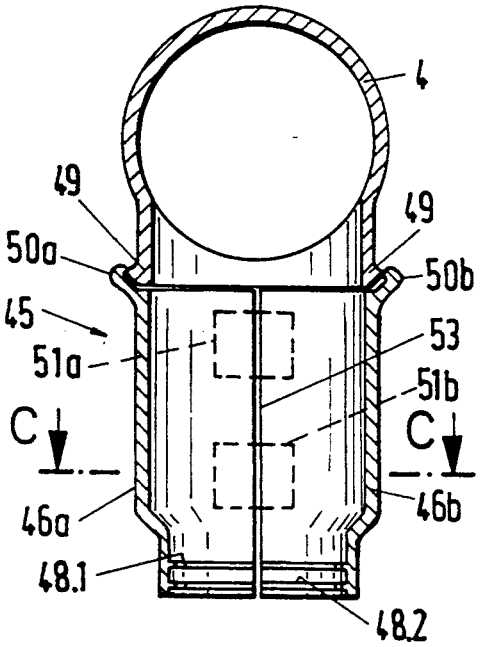
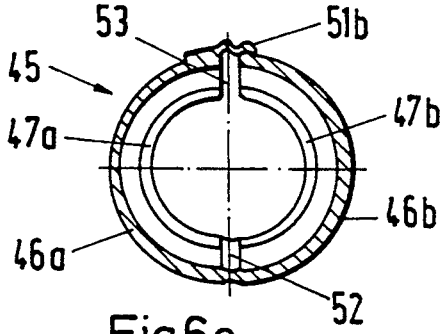
Fig.6e
(C-C)
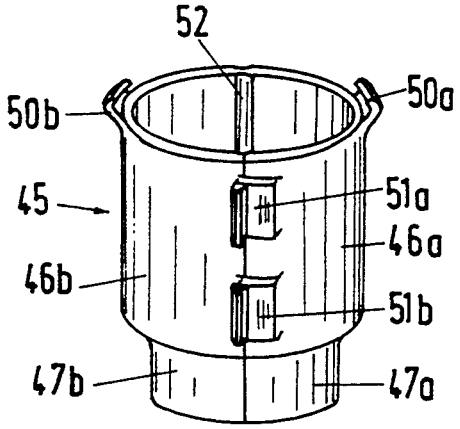
Fig.6f (A-A)

PLUMBING SYSTEM WITH CONNECTOR BETWEEN A FLEXIBLE PIPE CONDUIT LAID UNDERNEATH PLASTER AND A FITTING TO BE ARRANGED OUTSIDE THE PLASTER

FIELD OF ART

The invention relates to a device in a plumbing system to serve as a connector between at least one flexible piping installed underneath plaster and a fitting to be arranged on top of the plaster, comprising a casing and a pipe elbow insertable in the casing and affixable therein, wherein the casing, with a view toward a simple assembly of the pipe elbow at the at least one pipe conduit, can be opened toward the front in such a way that the pipe elbow, removed from the casing and connected to the end of the at least one pipe conduit, can be inserted in the casing from the front.

STATE OF THE ART

A device of the type mentioned above has been known, for example, from Swiss 663,814-A5. This involves a connector for drainage fittings as employed typically in bathroom installations. The device comprises a coupling section installed underneath the wall surface in a casing and connected to a flexible conduit, this coupling section being of angular shape and offering a coupling possibility for the fitting to be located on top of the plaster. The casing wherein the elbow section can be fixedly mounted can be sealed off from the front by means of a lid. In order to mount the coupling section to the piping, the flexible pipe conduit is bent somewhat out of the wall, and the coupling section is attached thereto. Thereafter, the coupling section is inserted from the front in the open casing and fixed therein. Finally, the lid is placed thereon, for example by means of clips. The advantage of this coupling device resides in that the pipe conduit (inner pipe), for connection to the pipe elbow, need not be pulled out of the protective pipe but rather needs only be bent outwards and, during insertion thereof, with the connected pipe conduit, also needs not be pushed back with great effort again into the protective pipe but rather can be simply bent backwards.

A housing that can be opened from the front has also been known from Swiss 650,823-A5. Here again, the pipe elbow mounted at the pipe conduit can be inserted in the housing from the front and covered by the attachable lid.

Various subsequent applications are based on the above-discussed basic idea, such as, for example, also EP-Bl-0 085 329, concentrated on subordinate structural design details of the housing.

Besides the above-described connection technique wherein, as mentioned, the pipe conduit is bent out of the wall for the purpose of mounting the coupling section and is then placed back into the coupling casing and mounted at that location, there also is another technique in contrast thereto wherein the pipe elbow in the casing is first attached to the wall or, respectively, in a wall recess, and then the pipe conduit, cut to the correct length, is connected. One example of a device based on this principle, which has been known for a long time, can be derived from German Utility Model GM 79 27 117. The pipe elbow is here fixed at a support on the wall. After connection of the pipe conduit, the pipe elbow and the coupling junction is each covered with a protective sleeve of a synthetic resin which can be fixedly clamped in place.

Coupling devices are also known wherein the pipe elbow is attached in a rubber sleeve to the wall so that thereafter the pipe conduit, cut to the correct length, can be connected thereto. A coupling casing for flexible piping, likewise based on this assembly technique, has been known from European Patent Application EP 0 354 177-A1. Here, too, the device is first fixed in place in a wall recess and then the flexible, cut to length pipe conduit is connected. Here again, a bipartite plastic protective sleeve is provided for covering the pipe elbow and, respectively, the coupling clamp.

The advantage of the aforementioned second assembly technique resides in that first the pipe elbow can be mounted at the correct site and then it is merely necessary to connect the pipe. The pipe elbow thus does not need to be held in one's hand during assembly. This also facilitates the attachment of the clamping ring device. However, a prerequisite for this convenient manner of assembly is that the wall recess be of adequate size so that it is conveniently possible to operate with a wrench. However, this is not always the case; rather, this depends on the respective conditions of the building. Problems are also encountered in case the casing cannot be attached within the wall recess so firmly that it can absorb the forces occurring during mounting (for example torques during attachment of the clamping ring coupling).

DESCRIPTION OF THE INVENTION

Therefore, it is an object of the invention to indicate a device of the type disclosed above which avoids the disadvantages inherent in the state of the art. In particular, the device is to be mountable in a simple and convenient fashion under a great variety of different conditions.

According to the invention, this object has been attained by providing that, for the purpose of creating an additional, alternative mounting possibility, the casing is divisible into a casing head and at least one casing neck attachable to the head in such a way that the pipe elbow inserted and affixed in the casing head projects from the casing head with its end to be connected to the at least one pipe conduit in such a manner that the at least one pipe conduit, cut to the correct size, can be connected to this end without having to remove the pipe elbow from the casing head; and that the at least one casing neck subsequently attached to the casing head encompasses the connected end of the pipe elbow as well as also a section of the connected, at least one pipe conduit.

The device according to this invention not only provides advantages from a mounting viewpoint but also from a manufacturing viewpoint. While heretofore the insertion of the normally metallic pipe elbow in the plastic casing caused extra efforts in those structural arrangements based on the principle of affixing the pipe elbow in the casing prior to connection, it is now possible without problems, on account of the casing of a short structure and with the possibility of being opened toward the front, to fix in place even relatively large pipe elbows in the associated casings as early as in the factory. The dimensions of these casings need no longer be of excessive size with a view toward insertion of the pipe elbow.

It is, of course, especially pleasant from the viewpoint of the assembler that he can decide at the site in which way he wishes to mount the coupling device.

Preferably, a clamping ring device with a cap nut is provided at one end of the pipe elbow for connecting the pipe conduit. The casing is separated into casing head and casing neck in such a way that the pipe elbow with the cap nut projects from the casing head. This ensures, thus, adequate free room for manipulation with a wrench during connection of the pipe conduit to the pipe elbow inserted in the casing head.

The casing neck is advantageously fashioned so that an outer pipe (protective pipe) of the pipe conduit can be fixedly clamped in place. This prevents the usually ribbed outer pipe from being pulled out of the casing neck and consequently no longer covering the inner pipe and, respectively, the coupling site. In case of a transversely ribbed pipe, this can be accomplished, for example, with a correspondingly dimensioned rib on the inside of the casing neck. The intended objective can be attained for outer pipes of any desired design by means of a clamping strap or the like.

In correspondence with an especially preferred embodiment, the features of which are usable also independently of the aforedescribed "multiple assembly casings", the casing neck exhibits, at the lower end facing away from the casing head, a pincerlike (respectively C-shaped) clamping member for the fixed clamping of the outer pipe. The clamping member can be operable with the aid of tools or by hand. A clamping member is especially advantageous which is fashioned in the manner of a unilaterally open ring showing radial resiliency on account of its configuration. In the rest condition, the inner diameter of the ring is somewhat smaller than the outer diameter of the pipe to be affixed. Therefore, the latter can be clamped in place radially. In order to mount a ribbed outer pipe, transverse ribs are suitable which are formed on the inside of the clamping member.

The clamping member is designed preferably as a substantially offset element. A connecting web providing a hinge-like mobility of the clamping member with respect to the casing neck joins the clamping member to the casing neck. The casing neck, the connecting web, and the clamping member are preferably made of one piece.

During introduction of the protective pipe into the casing neck, the clamping member can be bent backwards and subsequently, for the purpose of fixing the pipe in place, can be urged into its intended position. Thus, for assembly purposes, only a few and simple manipulations are required. In particular, a casing neck that cannot be flipped open, which is advantageous from a manufacturing viewpoint, in combination with the clamping member, will become substantially more attractive to the assembler.

In order to impart maximally variegated usage to the device of this invention, it is recommended to make the casing neck flexible. The casing can be utilized for 90° as well as for acute-angled, e.g. 70° , arrangements. Acute-angled devices are typically employed in lightweight wall construction applications.

For obtaining flexibility, a bellows-like section can be formed at the casing neck. However, it is also possible to manufacture the casing neck of an elastically or optionally plastically deformable material. Preferably, the casing neck is flexible only in the bellows-like section and is otherwise rigid.

If the casing neck surrounds the outer pipe so that it is leakproof with respect to dripping water, then water damage in case of minor leaks can be avoided.

In accordance with an especially preferred embodiment, the casing neck is tubular and is composed essentially of two half shells that can be joined in shape-mating fashion by means of connectors. Suitable connectors are locking closures that can be made of plastic, such as, for example, snap fasteners, snap closures, and the like. The casing neck can thus be mounted after connection of the pipe conduit to the pipe elbow, and need not be displaceable on the outer pipe (as, for example, in the state of the art according to EP 0 354 177-A1). In addition, the casing neck can also be mounted subsequently at any time and need not absolutely be pushed over the outer pipe prior to connection of the pipe conduit.

It is advantageous to equip the half shells with connecting means of the plug coupling type so that the casing neck can be mounted manually and without the help of tools. The same applies with regard to the connection between casing neck and casing head. Under practical conditions, it is furthermore advantageous to join the half shells on one side non-detachably to each other by means of hinge mechanisms. This avoids loss of one of the two half shells.

A casing neck that can be pushed over the outer pipe and can also fixedly clamp the latter in place is distinguished in that the plug coupling means exhibit at least two locking positions wherein, in the first position, the cross section of the casing neck is of adequate size for being able to push the casing neck over the outer pipe and, in the second position, is adequately small for fixedly clamping the outer pipe in place.

It is especially advantageous to fashion the connecting means between the casing neck and the casing head so that the casing neck can be attached to the casing head even if the plug connecting means have locked into the first position. In such a case, the casing can be handled like a quasi one-piece, coherent housing, for example when shipped from the factory. During assembly, the casing neck can then be removed from the casing head, pushed over the outer pipe, and, after connecting the inner pipe to the pipe elbow, can be fixed at the desired place by radial pressure to the outer pipe.

The aforementioned casing neck according to this invention can also be utilized independently of the remaining features of the invention. A casing neck composable of two half shells, or a casing neck with dual-locking plug connection can be used generally with all those casings separable into a casing head and a casing neck.

The casing head is, for example, cylindrical or, respectively, is derived from a cylinder with respect to its configuration, wherein the cylinder axis is substantially perpendicular to the axis of the pipe conduit (laid underneath the plaster). The side of the casing head facing the fitting to be connected on top of the plaster can be partially sealed with a lid or, respectively, a sealing ring. At the site where the pipe elbow is to project from the casing head (e.g. in the downward direction), the casing head is provided with a recess open toward the front so that the pipe elbow can be inserted in the casing head from the front. In order to be able to close off the casing head from the front and fix the pipe elbow in place, the casing head exhibits a thread on its side open toward the front; a locking ring can be threaded onto this thread. The locking ring surrounds the pipe elbow at its end facing the fitting that is to be mounted on top of the plaster.

If, in case of a repair, the inner pipe must be exchanged, then it is, of course, advantageous that the wall need not be bushhammered. A damage-free exchange is possible in principle in this invention since the locking ring at the front side of the casing can be unscrewed, and the pipe elbow with the connected inner pipe can be pulled out in a conventional manner. Considering such a repair step, it is advantageous for the locking ring not to encompass the casing from the outside but rather to be threadable into the casing. In accordance with an especially preferred embodiment of the invention, the casing therefore exhibits a snap ring that can be attached from the front; this snap ring supplements the inner thread partially arranged at the casing head. The locking ring can then be threaded into this inner thread, completed by the snap ring.

In order to prevent twisting of the pipe elbow during assembly of the above-plaster fitting, the casing head has in its interior at least one groove-like indentation, engaged in shape-mating fashion by a rib-like projection of the pipe elbow. When the pipe elbow is fixed in the casing by means of the locking ring, then the rib-like projection is located in the groove-like indentation. Preferably, the aforementioned elements are in dovetail-like engagement with each other.

Additional advantageous feature combinations of the invention can be seen from the following description and the dependent claims.

BRIEF DESCRIPTION OF THE DRAWINGS

The invention will be described in greater detail below with reference to embodiments and in conjunction with the drawings wherein:

FIG. 4*a* is a front elevational view of a casing with a snap ring, the view being partly in vertical section taken substantially on line B—B of FIG. 4*b;*

FIG. 4*b* is a vertical sectional view, with parts in elevation, taken along vertical center line of FIG. 4*a;*

FIG. 4*c* is a cross-sectional view taken substantially along line A—A of FIG. 4*b;*

FIG. 5*a* is a vertical sectional view, with parts in elevation, of a casing head;

FIG. 5*b* is a vertical cross-sectional view taken substantially on line B—B of FIG. 5*a;*

FIG. 5*c* is a horizontal cross-sectional view taken substantially along line A—A of FIG. 5*a;*

FIG. 6*a* is a vertical sectional view of a casing with a dual-locking position casing neck, showing the casing neck in a closed position;

FIG. 6*b* is a cross-sectional view taken substantially along line A—A of FIG. 6*a;*

FIG. 6*c* is a cross-sectional view taken substantially along line B—B of FIG. 6*a;*

FIG. 6*d* is a vertical sectional view similar to FIG. 6*a* showing the dual-locking position casing neck in a second of the two positions;

FIG. 6*e* is a cross-sectional view taken substantially along line C—C of FIG. 6*d;*

FIG. 6*f* is a perspective view of the dual-locking position casing neck shown in the closed position of FIGS. 6*a*–6*c;*

Basically, identical parts bear the same reference numerals in the various figures.

WAYS OF EXECUTING THE INVENTION

Figure 1:
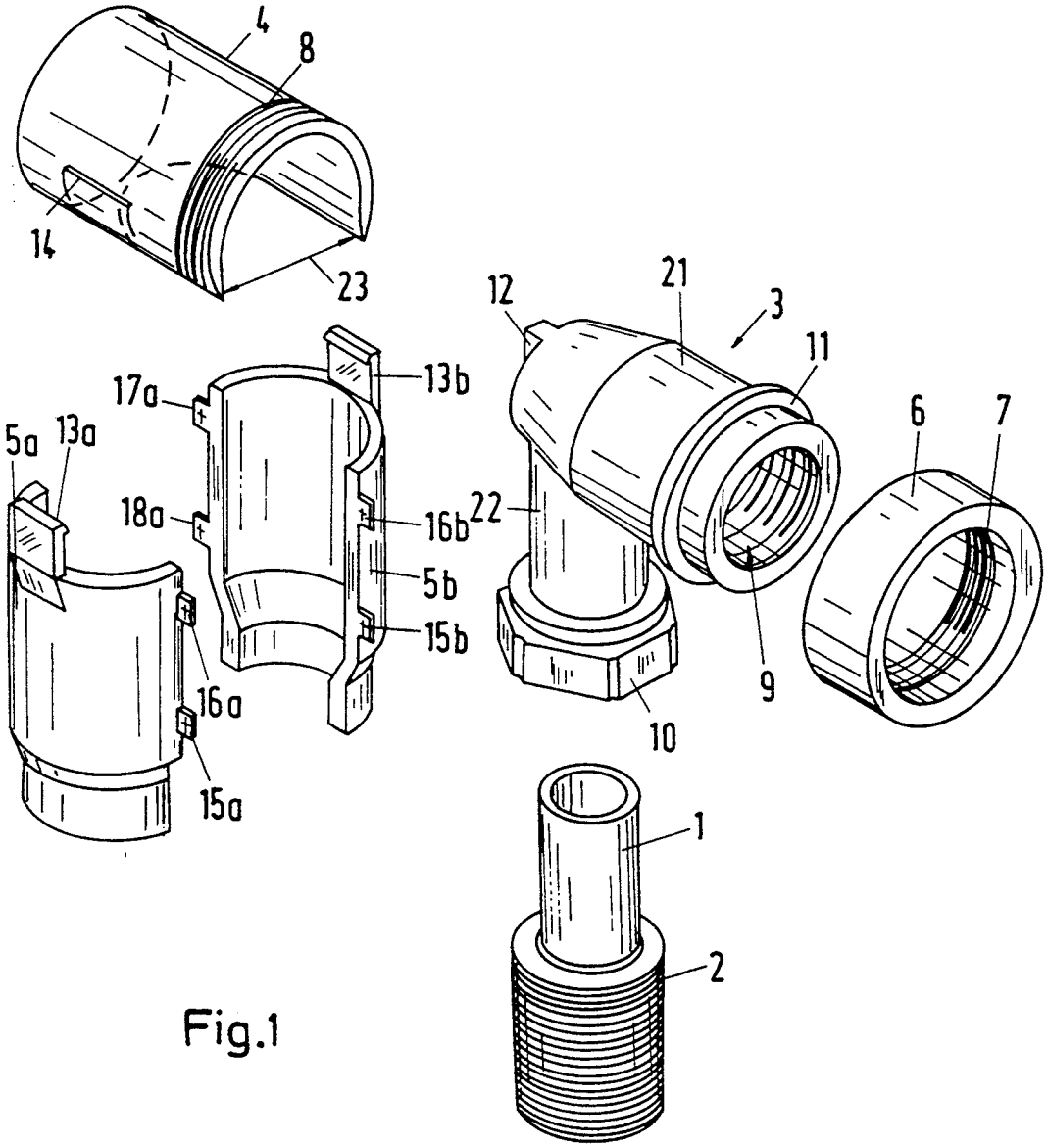
FIG. 1 is an exploded view of a device according to this invention.

FIG. 1 shows the individual parts of the device according to this invention in a perspective view. A pipe conduit, installed underneath plaster, with a flexible inner pipe 1 and a preferably ribbed and likewise flexible outer pipe 2 is to be joined to a pipe elbow 3 in such a way that a fitting to be installed above the plaster (for example a water faucet or a mixing head) can be connected thereto. In order to be able to wall up the pipe elbow 3 and the pipe conduit underneath the plaster, the pipe elbow as well as at least a section of the pipe conduit are to be covered by a casing. In case of a subsequent defect, it is thus possible, especially in case of pipe diameters that are not too large, to exchange the pipe elbow or, respectively, the inner pipe 1 without having to bushhammer the wall. Even if bushhammering should be absolutely necessary in case of large pipe elbows, this is required only to a very limited extent.

Inasmuch as the pipe conduit laid underneath the plaster extends substantially in parallel to the wall surface while the fitting must be connected, on the other hand, substantially perpendicularly thereto, the two openings of the pipe elbow 3 (one of which denoted by numeral 9 is visible) are standing essentially at a right angle to each other. The pipe elbow 3, normally consisting of metal, therefore has two pipe extensions 21 and 22 joined at a right angle to each other. The pipe extension 21, facing with its forward side the fitting to be mounted above the plaster, passes over toward the rear conically into the pipe extension 22 to be connected to the pipe conduit. A rib 12 is provided at the rear end of the slightly conical taper and accordingly in opposition to the opening 9. This rib extends preferably in the direction of the axis of the pipe extension 22. The significance of this rib 12, to be described further below, is related to the fixation of the pipe elbow 3 in the casing.

For being able to connect the inner pipe 1 to the pipe elbow 3, the pipe extension 22 has a clamping ring closure with a cap nut 10. The cap nut 10 encompasses the pipe extension 22 from the outside. The clamping ring closure is otherwise designed in a conventional fashion.

The cap nut 10 can be removable from the pipe extension 22 or can be connected to the latter in captive fashion.

The pipe extension 21 is provided with a stop flange 11 of annular shape, for example, this flange being slightly set back with respect to the opening 9. This flange makes it possible to fix the pipe elbow 3 in the casing.

Finally, the pipe extension 21 is equipped with an internal thread 7 for connection of the above-plaster fitting.

The casing protecting the just-described coupling member (3) is preferably composed of several individual parts. In the present case, these involve a cylindrical casing head 4, a casing neck composable substantially of two half shells 5*a*, 5*b*, and a locking ring 6.

The casing head 4 is designed, according to a preferred embodiment, so that it accommodates the entire pipe elbow 3 except for the cap nut 10. In the present example, the head is of a cylindrical shape, namely adapted more or less to the pipe extension 21. Once the pipe elbow 3 has been housed in the casing head 4, the axes of the cylindrical casing head 4 and of the pipe extension 21 extend in parallel to each other. The cylindrical casing head 4 exhibits in the outer wall a recess 23 for the pipe extension 22. This recess runs from the front in the axial direction toward the rear so that the pipe elbow 3 can be inserted with its pipe extension 22 from the front in the casing head 4. The recess 23 must, therefore, be at least of the same width as the diameter of the pipe extension 22.

As seen from the front, the casing head 4 thus has an arcuate appearance. Preferably, its angle extends over more than 180° . At its rear side, the casing head 4 is closed off. On its outside, it has, for example, suitable projections (one of which, denoted by 14, is visible) in order to attach the casing neck. The locking ring 6, which has a corresponding thread 7, can be threaded on a thread 8 arranged at the casing head at the front. Preferably, the lid is threaded in place in the manner of a cap nut. The locking ring 6 thus encompasses the casing head 4 and thus imparts to the latter a greater stability.

The casing neck is of tubular shape and is composed of the two half shells 5*a* and 5*b*. The tubular casing neck thus is, so to speak, split in the axial longitudinal direction. According to a preferred embodiment, the half shells 5*a* and 5*b* can be joined together. For this purpose, snap fasteners 15*a*/15*b*, 16*a*/16*b*, 17*a*/17*b*, 18*a*/18*b* are provided. For the attachment of the casing neck to the casing head 4, lugs 13*a*, 13*b* are arranged at the upper end of the casing neck. These lugs have catches which can lock into the projections 14 provided at the casing head 4 for this purpose. The internal diameter of the tubular casing neck is of such a size that it can accommodate the cap nut 10. At the lower end, the casing neck is narrowed to such an extent that the outer pipe 2 is clamped in place during assembly. The aforementioned constriction need not absolutely be visible from the outside. One that is solely on the inside is adequate, in principle.

Figures 2A, 2B, 2C, 2D, 2E:
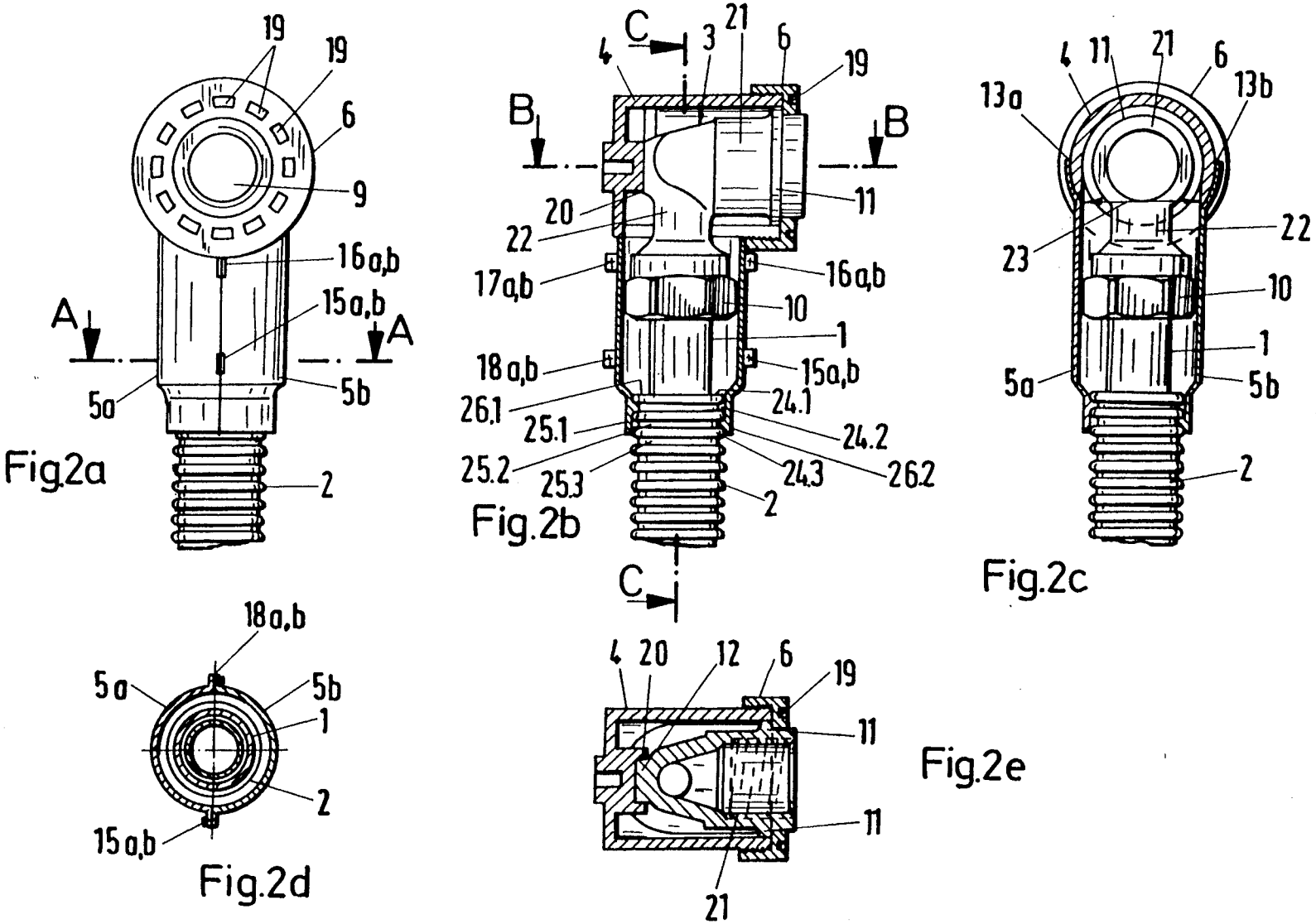
FIG. 2*a* is a front elevation view of the device according to the invention.
FIG. 2*b* is a vertical sectional view with parts elevation, taken along the vertical center line of FIG. 2*a;*
FIG. 2*c* is a vertical sectional view taken substantially on line C—C of FIG. 2*b;*
FIG. 2*d* is a cross-sectional view taken substantially on line A—A of FIG. 2*a;*
FIG. 2*e* is a cross-sectional view taken substantially along line B—B of FIG. 2*b;*

FIGS. 2*a*–*e* show the casing in the mounted condition. FIG. 2*a* illustrates a frontal view of the device according to the invention. It is understood, in this connection, that the pipe conduit (outer pipe 2), the casing neck (half shells 5*a*, 5*b*) and the casing head (covered up in FIG. 2*a*) are underneath the plaster. Only the locking ring 6 and the opening 9 for joining the above-plaster fitting can be seen. On its front side, the locking ring 6 has indentations 19 so that it can be threaded in place with a suitable tool (e.g. a plastic pipe with corresponding nubs at the end). The indentations are preferably distributed regularly along the circumference.

The opening 9 of the pipe elbow 3 accommodated in the casing is equipped, for example, with a thread into which the above-plaster fitting can be threaded. Of course, a pressure-tight connection of a different type can also be provided for connecting the fitting.

FIG. 2*d* shows a section A—A through the casing neck. The water-conducting inner pipe 1 is the innermost component. This pipe 1 is surrounded by an outer pipe 2 which, on the one hand, protects the inner pipe 1 and, on the other hand, provides noise damping (sounds of rushing water) The entire arrangement is encompassed by the casing neck with its two half shells 5*a*, 5*b* held together by suitable connecting means (snap fasteners 15*a*, 15*b* and 18*a*, 18*b*).

FIG. 2*b* shows the device in a longitudinal sectional view perpendicularly to the wall surface. The outer pipe 2 is retained by the casing neck with its narrowed end. The outer pipe 2 typically has transverse ribs 24.1, 24.2, 24.3 and transverse grooves 25.1, 25.2, 25.3. In order to prevent the outer pipe 2 from sliding out of the casing neck in the downward direction, the latter is equipped at its narrowed end with suitable peripheral ribs 26.1, 26.2. These engage into the transverse grooves 25.1 and 25.2. It is to be noted that the casing neck, in the assembled condition, thus cannot be moved over the outer pipe. Consequently, it is necessary in any event to effect the connection between the inner pipe 1 and the pipe elbow 3 prior to joining the half shells 5*a*, 5*b* so that the half shells then need only be placed around the pipe conduit.

The pipe elbow 3 is, as mentioned above, fixed in the casing head 4. For this purpose, a rib 12 is provided at the pipe elbow 3, this rib fitting into the mounting 20 provided on the inside at the rear wall of the casing head 4. In order for the rib 12 to remain in the mounting 20, these two elements are preferably designed so that they lock together in dovetail fashion.

The stop flange 11 at the forward end of the pipe extension 21 fits in shape-mating fashion into the casing head 4. The pipe extension 21 is thereby centered. Additionally, the stop flange 11 is arranged so closely toward the forward end of the pipe extension 21 that an axial force can be exerted on the pipe extension 21 in the direction of the mounting 20 by the threaded connection of the locking ring 6 which latter, in turn, shape-matingly surrounds the pipe extension 21 at its forwardmost end. Thus, in the final effect, the pipe elbow is retained in the casing head by the mounting 20 as well as by the locking ring 6.

FIG. 2*c* shows a section through the device according to this invention in parallel to the wall surface (section C—C). It can clearly be seen that the cylindrical casing head 4 surrounds the pipe extension 21 in arcuate fashion. The arc, formed in cross section, forms herein an angle of more than 180° . Thus, on account of the shape-matingly fitting stop flange 11, the pipe extension 21 is centered in the casing head even without the aid of the locking ring 6. The stronger the angular encompassing by the casing head 4 with respect to the pipe extension 21, the more rugged is this part of the casing. The recess 23 in the jacket of the casing head 4 must, of course, be at any event of at least the same size as the diameter of the pipe extension 22 so that the pipe elbow 3 can be inserted from the front. It can be clearly seen in FIGS. *2a–e* that the pipe extension 22 in a certain sense represents a constriction: The cap nut 10 as well as the pipe extension 21 with its stop flange 11 have a larger diameter than the pipe extension 22. If the recess 23 in the jacket of the casing head 4 is designed to be sufficiently narrow, then the pipe elbow 3, with the casing neck mounted, thus cannot be pulled out of the casing (even if the locking ring 6 has been removed). Rather, it can be inserted from the front only when the casing neck has been removed.

Figure 3:
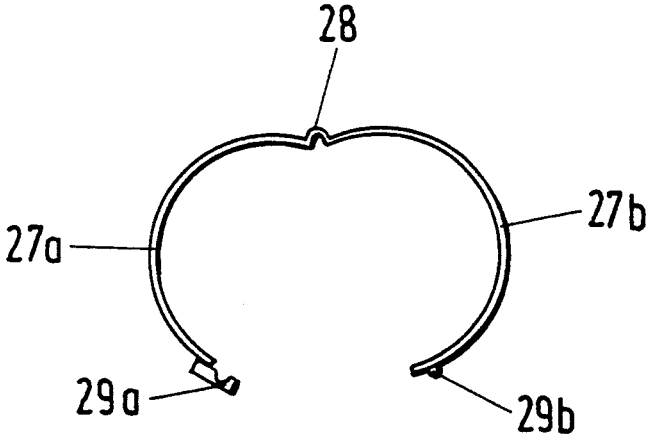
FIG. 3 is a section through a casing neck with two half shells joined by a hinge.

FIG. 3 shows an axial section through an especially preferred embodiment of the casing neck. In this arrangement, two half shells 27*a*, 27*b* are captively joined together by means of a hinge 28. The half shells 27*a*, 27*b* can be closed by means of one or several snap fasteners 29*a*, 29*b*. The hinge 28 is preferably constituted by a thin plastic skin which flexes easily. Since the casing neck need not be opened up frequently, a simple and inexpensive hinge construction is sufficient.

The following description relates to the two mounting methods made possible by the device according to this invention.

First of all, the mounting method is to be described wherein the pipe elbow 3 is inserted in the casing from the front. It is presupposed herein that a slot for the pipe and a cavity for the casing have been milled into the wall at the place where the above-plaster fitting is to be arranged. It is likewise assumed that the pipe conduit has already been laid within the wall.

First of all, the casing head 4 is attached in the milled-out slot in the wall at a suitable place. This predetermines the position of the fitting to be mounted on top of the plaster. The casing neck (half shells 5*a*, 5*b*) and the locking ring 6 have been previously removed. The pipe elbow 3 has likewise been taken out.

As the next step, the inner pipe 1 and the outer pipe 2 are cut back to the desired length. The flexible pipe conduit is bent, for this purpose, out of the slot perpendicularly to the wall surface. Thus, the work is not carried out in the tight space of the wall slot.

Thereafter, the pipe elbow 3 is mounted to the pipe end, cut to the correct size. This also is done out of the range of the slot. The connection, water pressure tight, is made possible by a conventional clamping ring closure, of which the cap nut 10 is illustrated in the figures. In order to be able to ensure a satisfactory coupling, the cap nut 10 must be tightened with considerable expenditure of force. Since, as mentioned above, this assembly step takes place on the inner pipe 1 pulled out of the wall slot, the pipe extension 21 can be retained, for example, with a large pair of pliers or with a pipe section threaded into the forward opening of the pipe elbow while the cap nut 10 is tightened with a wrench. The mechanic thus is given free hand and is not impeded by the narrowness of the wall slot.

Now the connected pipe elbow 3 is inserted from the front in the casing head 4 attached in the wall recess. Since the inner pipe has been cut to the correct length, the inner pipe 1 need not be shifted in the outer pipe 2 in the axial direction, as was absolutely necessary in the very old assembly technique. During the insertion step, the rib 12 locks into the mounting 20. The stop flange 11 centers the pipe extension 21 in the casing head 4, as set forth above. The pipe extension 22 is disposed in the corresponding recess of the casing head 4.

At this point, the locking ring 6 is threaded onto the casing head 4. Since the stop flange 11 projects preferably by a small amount past the forward end of the casing head 4, the pipe elbow 3 is urged in the rearward direction during the tightening of the locking ring 6 by threading. Accordingly, the pipe elbow is fixedly clamped between the casing head 4 and the locking ring 6. It can clearly be understood that, on account of this clamping action, the rib 12 is retained in the mounting 20 (even if these two elements are not equipped to be interlocking), and thereby a twisting of the pipe elbow about the axis of the pipe extension 21 is precluded.

Now the two half shells 5*a*, 5*b* are placed around the pipe conduit and the lower end of the pipe extension 22 and joined together with the use of the locking means (15*a/b*, 16*a/b*, 17*a/b*, 18*a/b*). During this step, the continuous ribs 26.1 and 26.2 provided on the inside are urged into corresponding grooves 25.1 and 25.2 of the outer pipe 2. With the use of the lugs 13*a*, 13*b* and the corresponding projections 14, the assembled casing neck is finally attached to the casing head 4. Thus the casing assembly is completed. Now it is merely necessary to close the wall slot by bricking or plastering, the casing protecting the pipe elbow 3 and its coupling (cap nut 10) with the inner pipe 1 against contamination.

The second type of assembly described below is of advantage, in particular, if the wall connections must be arranged in a large wall recess leaving much free space for manipulation.

As in the above-described case, the casing head 4 is first attached at the suitable site in the wall recess. During this step, the pipe elbow 3 is preferably already arranged in the casing head 4. The casing head 4, with the inserted pipe elbow 3 and the threaded-on locking ring 6 can thus be dealt with as a single part. This has the advantage that not a single one of them can get lost.

The inner pipe 1 and the outer pipe 2 are then cut to the correct length. Thereafter, the cut to length inner pipe 1 is connected, with the aid of the clamping ring closure (cap nut 10) to the pipe elbow 3 already mounted in the wall recess. It is not necessary in the present case to retain the pipe elbow 3 with pliers since it is, after all, clamped in the casing 4 and affixed to the building component directly or by means of mountings or, respectively, retaining irons. It is understood that the tightening of the cap nut 10 must be conducted with the required care. For if the attachment of the casing head 4 in the wall recess is too weak with respect to the applied torque for tightening the cap nut 10, then the casing head can be torn out of its anchorage.

Finally, the casing neck is, in turn, attached as described above. Thus, the difference between the two types of mounting resides in that, in the first, the pipe elbow is connected to the inner pipe outside of and, in the second type, within the wall protection or, respectively, the wall recess.

It is basically advantageous to be able to exchange the pipe elbow 3 for example in case of a defect or a leaking connection, with the inner pipe, or to exchange the inner pipe proper. In case of thick pipes (e.g. with 20 mm diameters and thereabove), it is definitely necessary in this step to bushhammer a portion of the wall. However, the pipe should have to be uncovered along a minimum length. This is ensured in the invention by the feature that the casing neck is fashioned as an element that can be broken up into parts and need not be pushed back over the outer pipe 2 to make the cap nut 10 accessible. Since, in case of such a repair, it is not desirable to have to detach the casing head 4 proper from the wall, the invention has the special advantage that the novel pipe elbow 3 can be inserted from the front in the casing head 4and can be fixed therein (clamping ring 6) and, simultaneously, the inner pipe 1 can be connected without difficulties to the pipe elbow 3 already fixed within the casing head 4. In spite of the flexibility of the pipe conduit, it not enough, for bending same outwards in the forward direction, to uncover the pipe conduit by bushhammering only for a length of 5–10 cm. Rather, definitely 20 cm and more must be uncovered by bushhammering so that the new pipe connection section can be conveniently joined to the pipe outside of the wall and can be inserted from the front. Therefore, the bilateral assembly possibility according to this invention has a positive effect also in case of repairs.

It is to be noted at this point that it is not absolutely necessary for the invention to provide an inner and outer pipe that is flexible, i.e. slightly bendable. The outer pipe can just as well be relatively stiff, for example.

FIGS. 4*a–c* show a casing equipped with a snap ring and an inner thread for a locking ring 33. In the present example, the casing neck 30 is inserted in the casing head 31 from below. This means that the casing head 31 encompasses with its lower opening the casing neck 30, the outer diameter of the latter being correspondingly dimensioned to be somewhat smaller. The pipe elbow 3 is fixed in the casing head 31 as described with reference to FIG. 2. This means that the rib 12, provided on the axial continuation of the pipe extension 21 on the rear side of the pipe elbow 3, is fixed in place in a mounting 20 formed on the inside of the casing head 3. During this step, the pipe elbow 3 is urged toward the rear into the mounting 20 on account of the locking ring 33 engaging at the stop flange 11 arranged on the pipe extension 21.

In contrast to the embodiment illustrated in FIG. 2, the locking ring 33 is here threaded into the casing head 31. On its front side, the casing head 31 has a suitable thread.

As already explained with reference to FIGS. 1 and 2, the casing head 31 has a recess 23. The pipe elbow 3 can be removed toward the front through this recess. In the present embodiment, a snap ring 32 is provided encompassing the forward opening of the casing head 31 from the outside. In the region of the recess 23 of the casing head 31 the snap ring 32 exhibits, on the one hand, a thread supplement 34 and, on the other hand, a housing cover filling the recess 23. While the casing head 31 in the present example provides about 300° of the internal thread for the locking ring 33, the complementary thread 34 covers up the remaining portion of about 60° . As mentioned above, the casing head 31 covers preferably at least 180° of the inner thread. However, it is just as well possible to make do with a smaller angle proportion in the casing head because the snap ring 32 will always cover the remaining angle proportion.

FIGS. 5*a–c* illustrate a preferred type of affixing a pipe elbow 44 in a casing head 35 according to this invention. It is the object of this type of mounting to transfer the forces active during assembly with maximum efficiency to the anchoring of the casing head. An analysis of the occurring forces and torques reveals that the forces that occur can best be absorbed and transferred in the point of intersection of the axis of the horizontal pipe extension 37 with that of the vertical pipe extension 36 of the pipe elbow 44. It is thus advantageous to provide means for absorbing the forces in the closest proximity of this center.

Accordingly, in the present embodiment, two flanges 38*a*, 38*b* are disposed at the forwardly oriented pipe extension 37, namely as close as possible to the axis of the vertical pipe extension 36. These flanges are retained in shape-mating fashion in suitable abutments 41*a*, 41*b* formed in the casing head 35 on the inside. A locking ring 39 is of such a structure that it fixedly retains, in the threaded-in position, the flanges 38*a*, 38*b* under pressure in the abutments 41*a*, 41*b*. Thereby, it is possible to absorb the torques effective in the axis of the pipe extension 37 as well as in the axis of the pipe extension 36.

Ears 43*a*, 43*b* are formed on the outside at the casing head 35. They lie in the same plane as the flanges 38*a*, 38*b*. The ears 43*a*, 43*b* are provided with bores 42*a*, 42*b* so that the casing head can be tightly attached by threading, for example, to a retaining iron or to the wall proper. A pipe elbow 44 anchored in this fashion will withstand even the forces exerted during tightening of the cap nut 10 (for connecting the inner pipe 1).

Analogously to the embodiment of FIG. 4, a snap ring 40 is included which can be inverted over the frontal open end of the casing head 35. Also, the cap nut 10 projects out of the casing head 35 in the downward direction.

An especially preferred embodiment of the casing neck will now be described furthermore with reference to FIGS. 6*a–f*. The casing head can be designed in correspondence with any one of the preceding examples. The casing head can also be designed in an entirely different fashion, i.e. it need not absolutely have the feature of opening toward the front.

The casing neck 45 consists essentially of two half shells 46*a*, 46*b*. Its inner diameter is typically of the same size as that of the casing head 4 at its lower end. The casing neck 45 is attached, by means of two suitably configured lugs 50*a*, 50*b*, to a continuously extending projection 49 of the casing head 4. The projection 49 is formed on the outside at the lower end of the casing head 4. The lugs 50*a*, 50*b* are of a hook shape and exhibit adequate elasticity for placing over the projection 49 and for being retained thereat by a snap connection.

At its lower end, the casing neck 45 is narrowed (constriction 47*a*, 47*b*). On the inside of the constrictions 47*a*, 47*b*, two continuously extending ribs 48.1, 48.2 are formed, for example. These ribs can retain the outer pipe 2 as explained in connection with FIG. 2.

The salient aspect in the present embodiment resides in that the two half shells 46*a*, 46*b* can be joined by suitable plug-in connecting means in such a way that they can form, at least in the zone of the constrictions 47*a*, 47*b*, two differently large internal cross sections. For this purpose, two snap closures 51*a*, 51*b* are provided, for example, which can assume two locking positions.

According to FIG. 6, a catch is formed, for example, at the half shell 46*b*; this catch can be placed over a lug that is M-shaped in sectional view. When the catch engages into one of the two throats of the M-shaped lug, then a gap 53 exists between the two half shells 46*a*, 46*b*. By compressing the casing neck by means of radial pressure, the catch will jump into the second throat of the M-shaped lug whereby the casing neck 45 forms a tight seal.

In the first locking position, the inner cross section in the region of the constrictions 47*a*, 47*b* is at least of such a size that the ribs 48.1, 48.2 are pushed over the ribbed outer pipe 2 (compare FIG. 2) more or less without impediment. As soon as the snap closures 51*a*, 51*b* engage, however, in the second position, the cross section in the region of the constrictions 47*a*, 47*b* is narrowed to such an extent that the ribs 48.1, 48.2 engage into the transverse grooves of the outer pipe (compare FIG. 2). The casing neck can then no longer be shifted with respect to the outer pipe.

According to an especially preferred embodiment, the connecting means (lugs 50*a*, 50*b*, projection 49) are fashioned so that they can hold the casing head and the casing neck together even if the casing neck has the larger cross section (compare FIGS. 6*d, e*). This can be achieved, for example, by providing that the lugs 50*a*, 50*b* extend over the projection 49 to such a degree that the engagement will not be lost even in case of the larger cross section. This is indicated in FIG. 6*d* by a gap between the casing head 4 and the casing neck 45.

It is, of course, advantageous, though not absolutely necessary, to provide that the two half shells 46*a*, 46*b* can be opened entirely so that the casing neck need not necessarily be pushed over the free end of the outer pipe but rather can also be placed therearound in gripper-like fashion. For this purpose, a hinge 52 is arranged diametrically in opposition to the snap closures 51*a*, 51*b*, this hinge connecting the two half shells 46*a*, 46*b*. This hinge 52 can be realized, for example, simply by a local reduction of the wall thickness of the casing neck 45. Of course, the remarks already set forth in connection with FIG. 3 relate to the hinge 52.

Figure 7A:
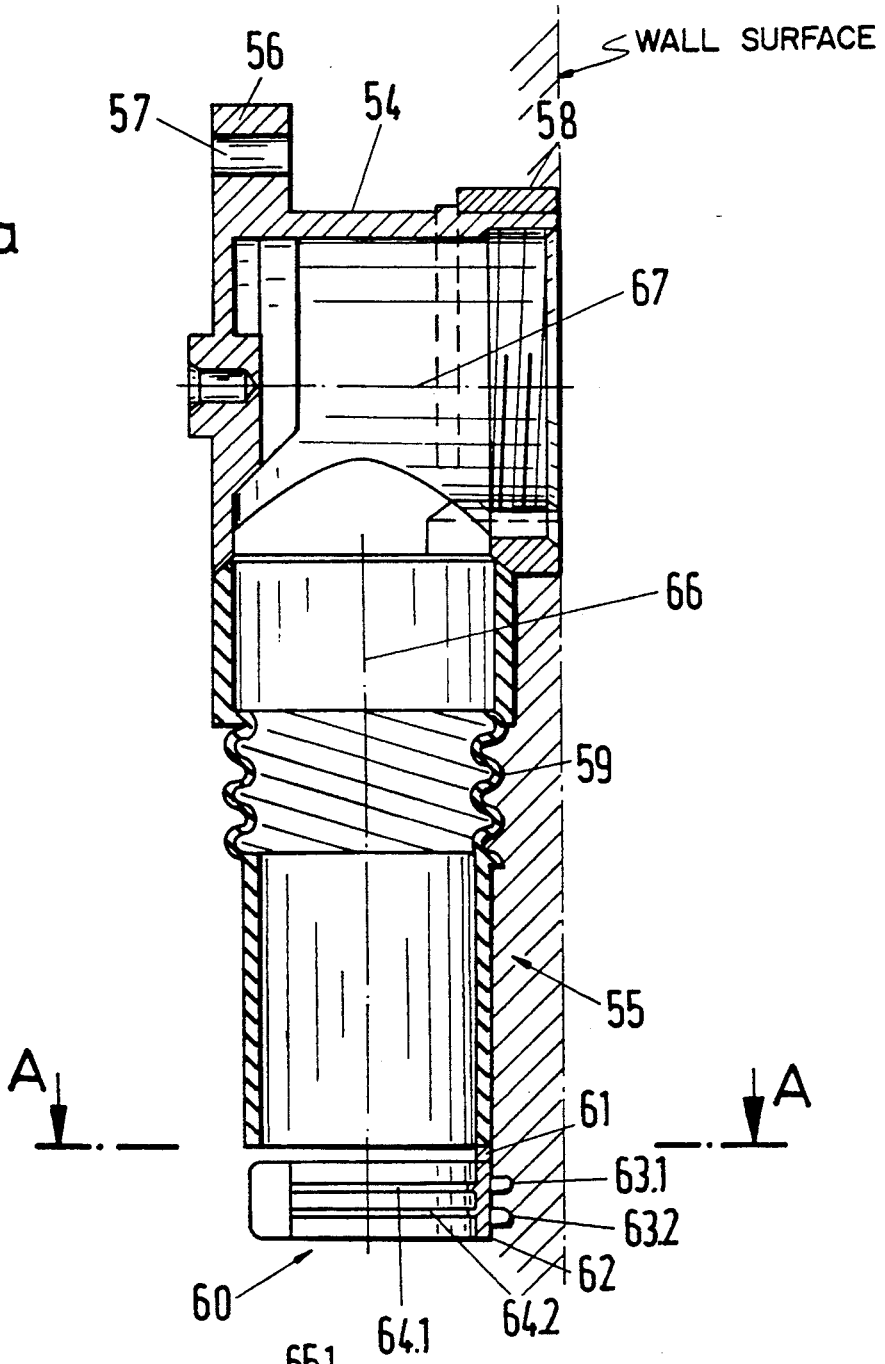
FIG. 7*a* is a vertical sectional view showing a casing with a flexible casing neck and a hinged resilient clamping member.

FIGS. 7*a, b* show a casing with a flexible neck and a pincer-like clamping member. A casing head 54 and a casing neck 55 can be composed into a casing (for example according to one of the above-described embodiments). A flange 56 with one or several bores 57 is formed at the casing head 54. The casing head 54 can be attached to this flange 56 at the desired location in a wall recess.

A snap ring 58 serves for closing the casing head 54 in a way explained with reference to FIGS. 4*a–c*.

The casing neck 55, in accordance with a further advantageous embodiment of the invention, comprises a section with a bellows 59. The latter makes it possible to bend the lower end of the casing neck 55, facing away from the casing head 54, with respect to the longitudinal axis 66. The lower end of the casing neck 55 can thus be adjusted into a 60° position, for example, with respect to the frontal opening axis 67 (normally oriented perpendicularly to the wall surface).

Another special feature of the embodiment according to FIGS. 7*a* and *b* is the clamping member 60 attached to the lower end of the casing neck 55. As can be seen from FIG. 7*b* (showing a section A—A according to FIG. 7*a*), this is essentially an open ring 62. This ring is provided, for example, with externally extending continuous reinforcing ribs 63.1, 63.2. Two lugs 65.1, 65.2 are disposed at the ends of the ring 62. Two transverse ribs 64.1, 64.2 are formed for example, on the inside of the ring. The ring 62 is connected to the casing neck 55 by way of a connecting piece 61.

Figure 7B:
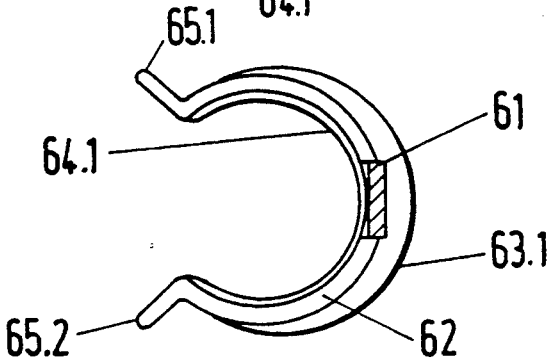
FIG. 7*b* is a cross-sectional view taken substantially along line A—A of FIG. 7*a;*

As can be derived from FIG. 7*b*, the ring-shaped clamping member advantageously has a center angle on the order of 270° . The lugs 65.1, 65.2 project radially toward the outside. An angle of 90° is formed between the two lugs 65.1, 65.2 and the annular part of the clamping member.

Owing to its shape, the clamping member 60 can be bent apart, while overcoming an inherent spring force, and can be placed over a ribbed protective pipe. When the lugs 65.1, 65.2, provided for the radial unbending of the ring 62, are released, then the ring 62 will encompass the protective pipe in the manner of pincers, the ribs 64.1, 64.2 engaging into corresponding grooves of the protective pipe. In this way, the protective pipe is fixed in the direction of the longitudinal axis 66. It can thus not slip out of the casing neck.

The connecting piece 61 is fashioned so that, on the one hand, it can absorb the occurring tensile forces without breaking and, on the other hand, it does not impair the radial movability of the ring ends.

According to an especially preferred embodiment, the clamping member 60 can be flipped back in hinge-like fashion about the connecting piece 61. In order to create the corresponding mobility, it is enough to make the connecting piece 61 of suitable thinness (optionally with an additional constriction). The casing parts, including the clamping member, are typically injection-molded from a synthetic resin.

Figures 8A, 8B, 8C:
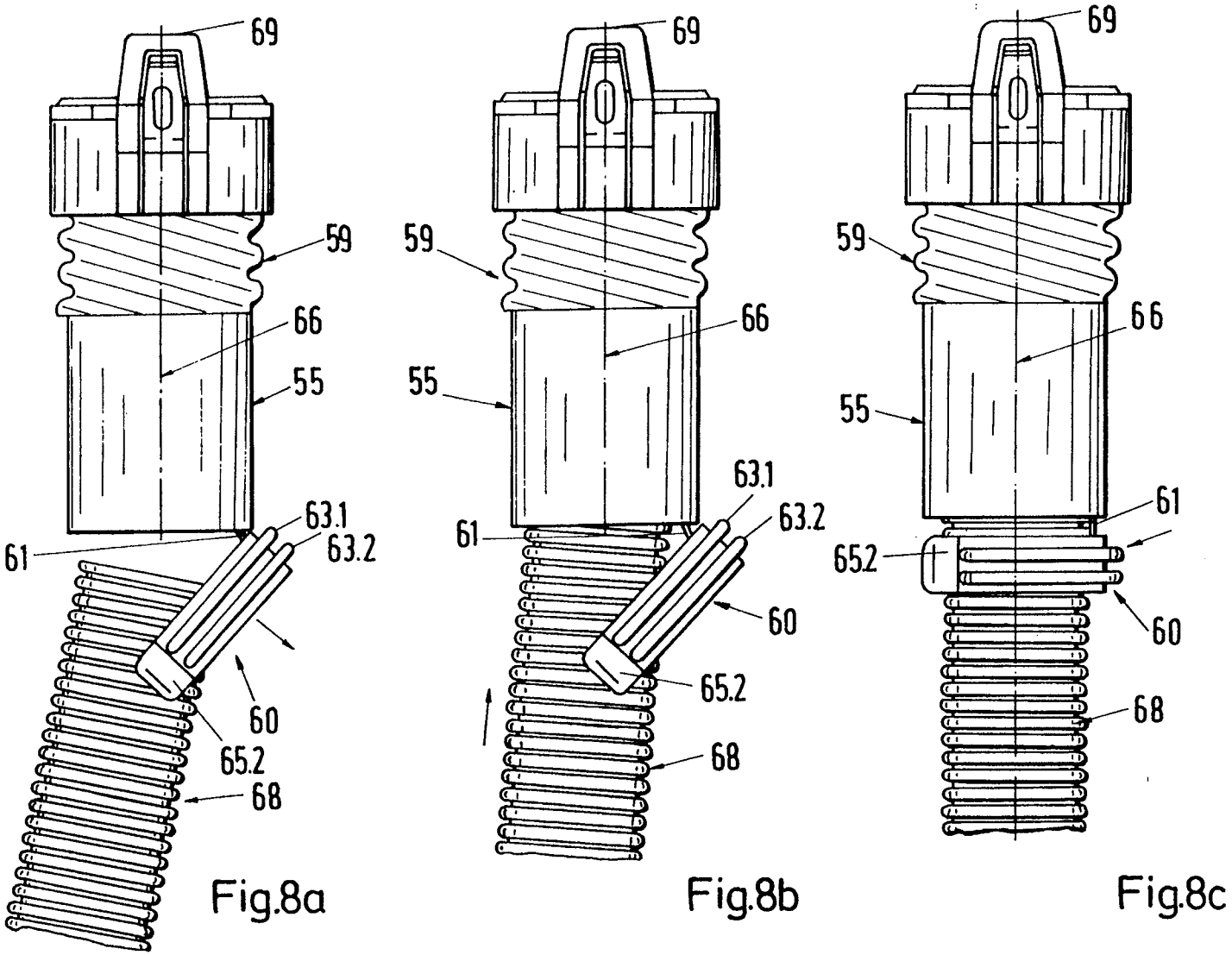
FIGS. 8*a*, 8*b*, and 8*c* show an illustration of the most important assembly steps during mounting of a casing neck to an outer pipe.

The procedure during mounting of the casing neck will now be described with reference to FIGS. 8*a–c*. The casing neck 55 is of tubular shape in the present case. In particular, the casing neck cannot be flipped open along a longitudinal axis. This means that the neck must be guided over a protective pipe 68. In other words, it must be displaceable, under certain conditions, along the ribbed protective pipe 68. According to the present example, this displaceability is achieved by flipping the clamping member 60 back about the connecting piece 61 (FIG. 8*a*).

Figure 9:
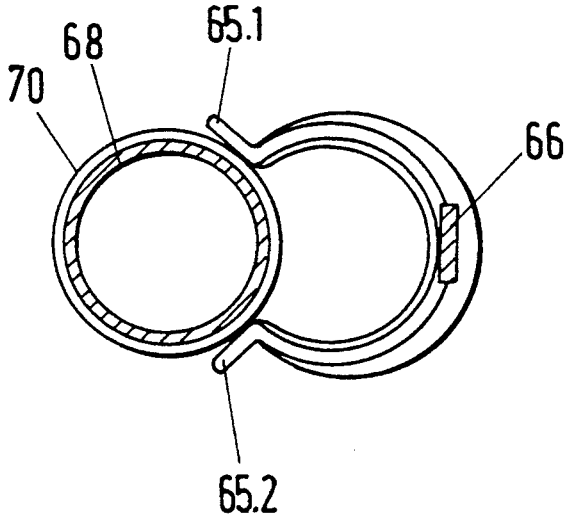
FIG. 9 shows a representation of the lateral sliding of the clamping pipe along the outer pipe.

As can be derived from FIG. 9, the clamping member is in lateral contact with the protective pipe 68. With its lugs 65.1, 65.2, it slides over the ribs 70. On account of the fact that the axis of the clamping member is at an oblique (e.g. 45° ) angle with respect to the longitudinal axis of the protective pipe 68, the ribs 70 can "slip through" under the lugs 65.1 and 65.2. This is additionally enhanced by the not particularly acute angle between the lugs 65.1, 65.2 and the circular-arc-shaped inner wall of the clamping member.

After the clamping member 60 has been flipped toward the side in the downward direction, the protective pipe 68 is inserted from below in the casing neck 55 (compare FIG. 8*b*).

In order to fix the protective pipe 68 in the casing neck 55, the clamping member 60 is finally brought into a coaxial position to the protective pipe 68 by a rotation about the connecting piece 61. The lugs 65.1, 65.2 are pushed during this step past the diameter of the protective pipe 68, utilizing the radial elasticity of the annular clamping member. The transverse ribs 64.1, 64.2 (compare FIGS. 7*a, b*) snap into grooves of the protective pipe 68. The casing neck 55 is thus non-detachably clamped fixedly to the protective pipe 68. The connection can only be overcome by radially opening the clamping member by means of urging the lugs 65.1, 65.2 apart.

Thereafter, the casing neck 55 can be attached to the casing head 54 in locking fashion by means of two fastening lugs (of which only one, bearing reference numeral 69, can be seen in FIGS. 8*a–c* on account of the chosen perspective).

Another preferred embodiment of the invention will be described with reference to FIG. 10. This involves a so-called lightweight building wall casing. Such a casing is inserted in a lightweight building wall in such a way that it is flush on the visible side and projects therefrom toward the rear.

Figure 10:
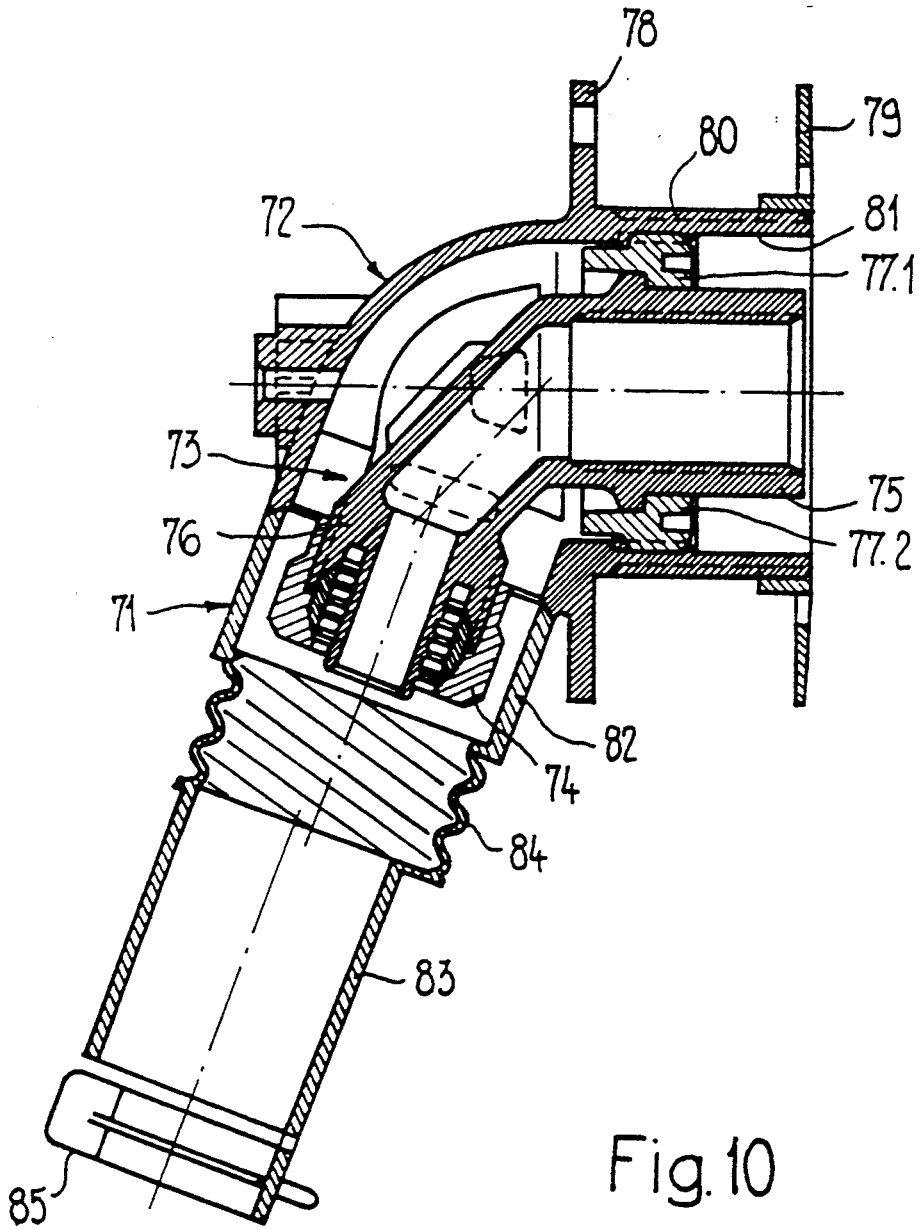
FIG. 10 is a sectional view of a lightweight construction wall casing.

As can be seen from FIG. 10, an acute-angled arrangement is involved wherein the axis of the pipe supplying the usage water forms a 70° angle with the axis of the drain.

As in the embodiments described hereinabove, a casing neck 71 is attachable to a casing head 72, for example by means of a plug-in connection. The subdivision into casing head 72 and casing neck 71 is chosen so that a cap nut 74 of a pipe elbow 73 (which likewise exhibits a 70° angle between inlet and outlet) projects from the casing head 72 in the downward direction or, respectively, obliquely in the rearward direction when the casing neck 71 has been removed. The forwards-pointing pipe extension 75 (for the connection of a fitting) has a length corresponding approximately to the thickness of the lightweight building wall.

The obliquely downwardly pointing pipe extension 76 comprises the aforementioned clamping ring closure for the fixed clamping of a plastic pipe.

The pipe elbow 73 is firmly threaded within the casing head 72 by means of screws 77.1, 77.2 from the visible side of the lightweight building wall. The screws 77.1, 77.2 are seated between the pipe extension 75 and an extension 81 of the casing head 72, encompassing the extension 75.

A sleeve 80 is arranged displaceably on the outside of the extension 81 which latter is tubular, for example. On the front side, a mounting flange 79 projects radially toward the outside from this sleeve. Due to the movability of the sleeve 80 on the extension 81, the casing can be utilized for various wall thicknesses.

At the rear end of the extension 81, the casing head 72 has a mounting flange 78. The latter can be fixedly threaded to the rear side of the lightweight building wall. The sleeve 80 can be placed onto the extension 81 from the visible side of the lightweight building wall. It is furthermore provided with holes for mounting to the front side of the lightweight building wall. The lightweight building wall is thus clamped in sandwich fashion between the rear mounting flange 78 formed at the casing head 72 and the front mounting flange 79 movably supported on the casing head 72. This results in a good fixation of the casing.

The casing neck 71 is fashioned to be flexible in accordance with a version of the invention described in detail above. The neck has a first and a second rigid section 82 and 83, respectively, and an interposed flexible section 84. A clamping member 85 is formed at the lower end of the rigid section 83; this clamping member has also been described above. The casing neck 71, including the clamping member 85, is made integrally of a synthetic resin. The flexible section 84 obtains its property, for example, by reducing the wall thickness with respect to the remaining sections, and by having the wall corrugated in bellows-like fashion.

Figures 11A, 11B:
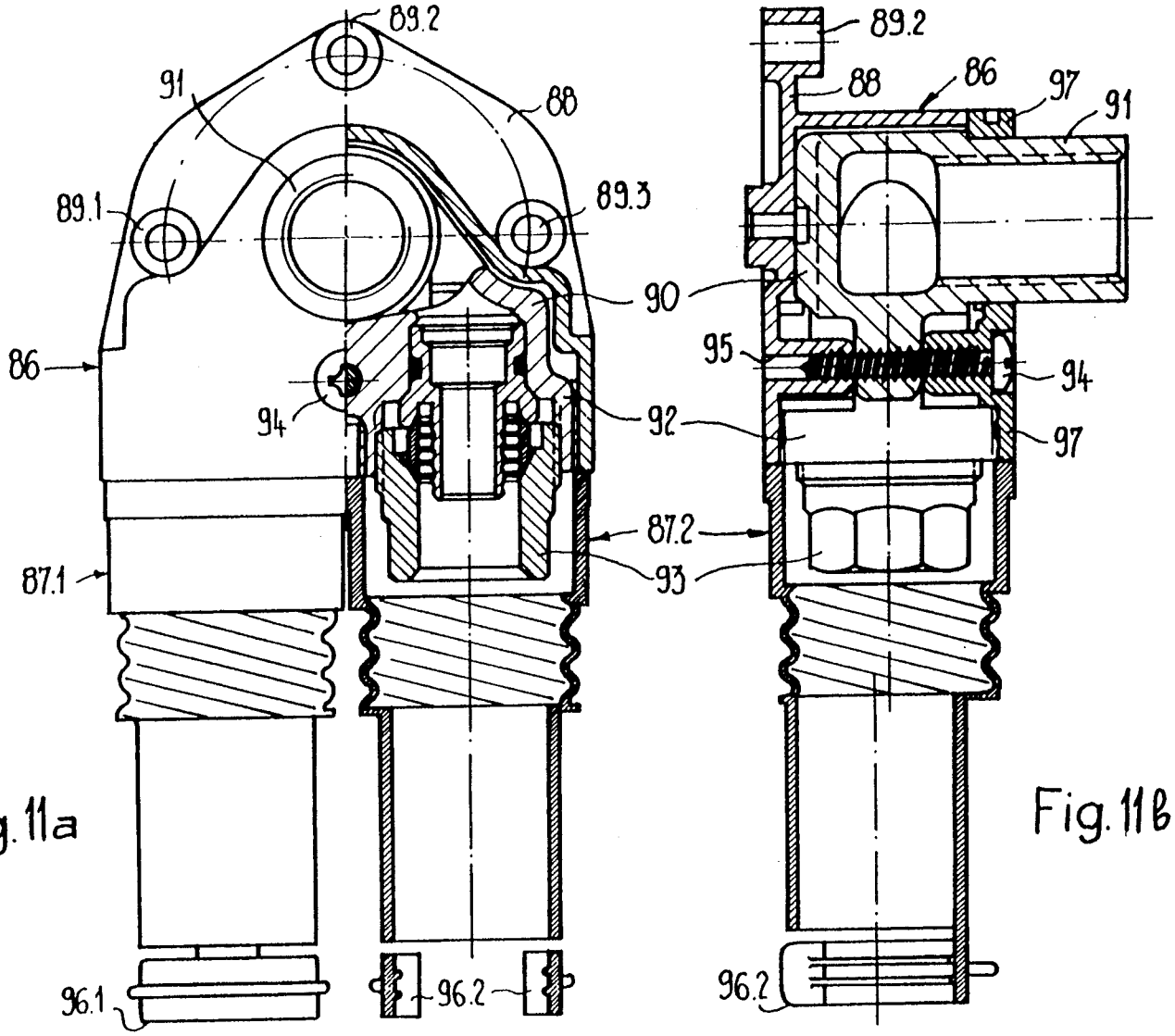
FIGS. 11*a* and 11*b* show an illustration of a double casing according to this invention.

In FIGS. 11*a, b,* a double casing is illustrated. Two casing necks 87.1, 87.2 can be attached to a casing head 86. The casing can furthermore be opened from the front. For this purpose, a lid 97 can be attached by means of a screw 94 to the remaining part of the casing (bore 95 in the rear portion of the casing head 86). The screw 94 also affixes, at the same time, a coupling element 90 in the casing head 86. The coupling element 90 has a bore, for this purpose, placed between a fitting coupling attachment 91 and the two conduit couplings (compare reference numeral 92).

Also in this embodiment, accessible from the front as well as from the bottom, the cap nuts (compare reference numeral 93) which are part of the clamping ring closure for attaching the water pipes extend in the downward direction out of the casing head 86 once the two casing necks 87.1, 87.2 have been removed.

The casing necks have the structure shown in FIG. 10, i.e. they are flexible at least in sections and exhibit, at the bottom end, a clamping member 96.1, 96.2 for the fixed clamping of the protective pipes.

In order to attach the casing head in a wall recess, a mounting plate 88 is formed at the head. This plate is essentially flush with the rear side of the casing and exhibits, for example, three bores 89.1, 89.2, 89.3 for screws.

The invention is, of course, not limited to the embodiments described with reference to the figures. Variations of the structural details are definitely within the scope of the invention.

Thus, it is possible, for example, to construct the casing neck and casing head so that they can be connected with each other in the manner of a bayonet catch. Likewise, a threaded connection is also possible. It is advantageous, in any event, for the casing neck to be attachable to the casing head without special tools, i.e. manually.

There is also a great number of possibilities of variation in the fixation of the pipe elbow in the casing head. Instead of a dovetail-shaped mounting at the rear end of the casing head 4, it is also possible to provide recesses in the stop flange 11 engaged in shape-mating fashion by suitable nubs arranged on the inside of the casing head 4. Any twisting of the pipe elbow can also be prevented by such interlocking elements.

The pipe elbow proper can also be, for example, a simple pipe bend provided at one end with a suitable clamping ring closure and at the other end with a thread (for the connection of an above-plaster fitting). Quite generally, for purposes of the invention, a pipe elbow is a coupling element which connects a pipe conduit with a fitting or with a further pipe conduit.

In place of a single pipe conduit, it is also possible to provide two (or more) such conduits for coupling (for example in case of a ring conduit system). In this case (i.e. in case of a so-called double casing), the casing neck is to be designed for two pipes. The casing head, of course, must be broadened correspondingly, so that enough room remains in the downward direction for the pipe couplings. It is, of course, also possible to connect to the casing head two individual, tubular casing necks. The pipe elbow, in this case, is fashioned, for example, in a U-shape, the two ends of the U-shape being connected to the ring conduit system laid inside the wall. In the center of the arc of the U-shape, a forwardly open pipe extension is provided for the connection of the fitting to be mounted on top of the plaster. Finally, in case the pipe elbow has a T-shaped design, the casing head has two diametrically opposed, removable casing necks. Therefore, within the scope of the invention, a pipe elbow is understood to mean any fitting that is suitable for serving as an intermediate section between one or several pipes underneath the plaster and one or several fittings above the plaster.

It is clear that the various casing neck types can be designed independently of the type of casing head. In particular the casing necks can be utilized, in principle, in combination with any illustrated casing head, in selective fashion.

A typical field of use of the invention is constituted by sanitary installations. However, the invention can also deploy its advantageous effects in heating systems or fuel supply systems.

In summation, it can be stated that the device according to this invention is extremely versatile and can be conveniently installed also in case of differing building standards.

I claim:

1. A connection assembly between at least one flexible pipe conduit (1, 2) adapted to be installed underneath the surface of a wall and a fitting adapted to be positioned on top of the wall surface, comprising a casing, a pipe elbow (3) removably insertable in the casing and affixable therein;

said casing (4, 5*a*, 5*b*) comprising a cylindrical casing head (4) with a front and a rear end, at least one casing neck (5*a*, 5*b*) detachably connected to said casing head, and a locking ring detachably connected to said front of said casing head;

a pipe clamping ring and cooperating cap nut (10) connected on one end (22) of the pipe elbow (3) for connecting a pipe conduit (1) to said pipe elbow, said pipe elbow having a second end (21);

said cylindrical casing head having a bottom side with an opening (23) extending from the front to the rear end of said bottom side, said cylindrical casing head having a lower end adjacent the opening, said one end of said pipe elbow which carries said cap nut extending through said opening thereby ensuring a simple assembly of the pipe elbow (3) to an at least one pipe conduit (1); the front end of said cylindrical casing head being open towards the front, said locking ring detachably connected to said front end of said casing head engaging said second end (21) and retaining said pipe elbow in said casing head, whereby said pipe elbow (3) is removable from said casing head by detaching said locking ring from said front end, and said pipe elbow (3) removed from the casing and connected to the end of an at least one pipe conduit (1) is insertable in said casing head (4) from the front end;

said pipe elbow (3) connected in said casing head (4) by said locking ring having said cap nut (10) on said one end (22) projecting outwardly from said casing head (4) beyond said lower end, whereby an at least one pipe conduit (1) may be coupled to said one end (22) with said cap nut (10) without the pipe elbow (3) having to be removed from said casing head, thereby providing an alternate mode of connection;

and means for detachably connecting said at least one casing neck (5*a*, 5*b*) at an intersecting angle to said cylindrical casing head (4) encompassing the cap nut (10) on said one end (22) of the pipe elbow (3) as well as a portion of an at least one pipe conduit (1) connected thereto.

2. A connector assembly as set forth in claim 1, the at least one flexible pipe conduit (1, 2) including an inner pipe conduit (1) for connection by said cap nut (10) to said pipe elbow, and an outer pipe (2) coaxial with said inner pipe, and clamp means on said casing neck (5*a*, 5*b*) engageable with the outer pipe (2) to fixedly clamp the outer pipe (2) thereto so it cannot slip out of said casing neck (5*a*, 5*b*).

3. A connector assembly as set forth in claim 1, in which said casing neck (5*a*, 5*b*) is tubular and is composed of two mating half shells, and connecting means (15*a/b*, 16*a/b*, 17*a/b*, 18*a/b*) connecting said two half shells into the tubular shape.

4. A connector assembly as set forth in claim 3, in which said means for detachably connecting (13*a*, 13*b*, 14) comprise plug type connectors extending between said half shells (5*a*, 5*b*) and said casing head (4), whereby said casing neck (5*a*, 5*b*) can be manually attached without the aid of tools to said casing head (4).

5. A connector assembly as set forth in claim 3, in which said connecting means include hinge means integrally connected between said half shells (5*a*, 5*b*) on one side.

6. A connector assembly as set forth in claim 1, and a thread (7) on said front end of said cylindrical casing head (4) that is open toward the front, and mating threads on said locking ring (6) detachably threadably connecting with said thread (7) on the front end of said casing head (4) whereby said locking ring connects said pipe elbow (3) in said casing head (4).

7. A connector assembly as set forth in claim 31, in which said rear end of said casing head (4) is provided in its interior with at least one mounting means, and a rib-like projection (12) on said pipe elbow (3) engaged with said mounting means, thereby preventing twisting of the pipe elbow (3) during assembly.

8. A connector assembly as set forth in claim 3, in which said connecting means include plug-in connecting means (51*a*, 51*b*) having at least two locking positions provided for joining said two half shells (46*a*, 46*b*) of the casing neck (45), the at least one flexible pipe conduit including an inner pipe conduit (1) and an outer pipe (2) coaxial with said inner pipe, said plug-in connecting means in a first locking position positioning said two half shells to a cross section of adequate size for being able to push the casing neck (45) over said outer pipe (2), and said plug-in connecting means in a second position positioning said two half shells to a smaller cross section to clamp the outer pipe (2) in place in said casing neck.

9. A connector assembly as set forth in claim 8, in which said means for detachably connecting (50*a*, 50*b*, 49) comprise plug type connectors extending between said half shells (46*a*, 46*b*) and said casing head (4) , and said plug type connectors operative to attach said casing neck (45) to said casing head (4) even said plug-in connecting means 51*a*, 51*b*) are locked in the first locking position.

10. A connector assembly as set forth in claim 1, including a pincer-like clamping member (60) on an end of said casing neck (55) facing away from said casing head (54) for the fixed clamping of said flexible pipe conduit (1, 2) to said casing neck.

11. A connector assembly as set forth in claim 10, in which said pincer-like clamping member (60) is a unilaterally open, radially resilient, ring.

12. A connector assembly as set forth in claim 11, in which said open ring (60) has an inner surface having at least one transverse rib (64.1, 64.2) thereon, said flexible pipe conduit (1, 2) including an inner pipe conduit (1) and an outer ribbed pipe (2) coaxial with said inner pipe conduit, said at least one transverse rib engaging said outer ribbed pipe (2), and hinge means connecting said clamping member (60) to the said end of said casing neck (55) facing away from said casing head (54).

13. A connector assembly as set forth in claim 1, in which said casing neck (55) is constructed as a flexible (59) casing neck.

14. A connector assembly as set forth in claim 13, including a bellows-like section (59) included in said casing neck (55) whereby said casing neck is rendered flexible.

15. A molded plastic casing for a water pipe elbow (3) removably insertable in the casing and affixable therein, said casing (4, 5*a*, 5*b*) comprising a cylindrical casing head (4) with a front end and a rear end, at least one casing neck (5*a*, 5*b*) detachably connected to said casing head, and a locking ring detachably connected to said front of said casing head;

a pipe clamping cap nut (10) connected on one end (22) of the pipe elbow (3) for connecting a pipe conduit (1) to said pipe elbow, said pipe elbow having a second end (21);

said cylindrical casing head having a bottom side with an opening (23) extending from the front end to the rear end on said bottom side, said cylindrical casing head having a lower end adjacent the opening, said one end of said pipe elbow which carries said cap nut extending through said opening thereby ensuring a simple assembly of the pipe elbow (3) to an at least one pipe conduit (1);

the front end of said cylindrical casing head being open towards the front, said locking ring detachably connected to said front end of said casing head engaging said second end (21) and retaining said pipe elbow in said casing head, whereby said pipe elbow (3) is removable from said casing head by detaching said locking ring from said front end, and said pipe elbow (3) removed from the casing and connected to the end of a pipe conduit is insertable in said casing head (4) from the front end;

said pipe elbow (3) connected in said casing head (4) by said locking ring having said cap nut (10) on said one end (22) projecting outwardly from said casing head (4) beyond said lower end, whereby a pipe conduit may be coupled to said one end (22) with said cap nut (10) without the pipe elbow (3) having to be removed from said casing head, thereby providing an alternate mode of connection;

and means for detachably connecting said at least one casing neck (5*a*, 5*b*) at an intersecting angle to said cylindrical casing head (4) encompassing the cap nut (10) on said one end (22) of the pipe elbow (3) and a portion of a pipe conduit (1) connected thereto.

16. A molded plastic casing as set forth in claim 15, constructed as a double casing.

17. A plumbing system comprising, a flexible pipe conduit (1, 2) having a flexible inner pipe (1) adapted to convey liquid, and a flexible outer pipe (2) surrounding and protecting said inner pipe;

said outer pipe having a greater diameter than the diameter of said inner pipe whereby said inner pipe can be guided in said outer pipe;

said flexible inner pipe and said flexible outer pipe being substantially coextensive in length;

a casing;

a pipe elbow (3) removably insertable in the casing and affixable therein, said casing (4, 5*a*, 5*b*) including a cylindrical casing head (4) with a front end and a rear end, at least one casing neck (5*a*, 5*b*) detachably connected to said casing head, and a locking ring detachably connected to said front of said casing head;

a pipe clamping cap nut (10) connected on one end (22) of the pipe elbow (3) for connecting said flexible inner pipe (1) to said pipe elbow, said pipe elbow having a second end (21);

said cylindrical casing head having a bottom side with an opening (23) extending from the front end to the rear end on said bottom side, said cylindrical casing head having a lower end adjacent the opening, said one end of said pipe elbow which carries said cap nut extending through said opening thereby ensuring a simple assembly of the pipe elbow (3) to said, flexible inner pipe (1);

the front end of said cylindrical casing head being open towards the front, said locking ring detachably connected to said front end of said casing head engaging said second end (21) and retaining said pipe elbow in said casing head, whereby said pipe elbow (3) is removable from said casing head by detaching said locking ring from said front end, and said pipe elbow (3) removed from the casing and connected to the end of said flexible inner pipe is insertable in said casing head (4) from the front end;

said pipe elbow (3) connected in said casing head (4) by said locking ring having said cap nut (10) on said one end (22) projecting outwardly from said casing head (4) beyond said lower end, whereby said flexible inner pipe may be coupled to said one end (22) with said cap nut (10) with the pipe elbow (3) connected in said casing head, thereby providing an alternate mode of connection;

said at least one casing neck (5*a*, 5*b*) engageable over the end of said flexible outer pipe (2);

and means for detachably connecting said at least one casing neck (5*a*, 5*b*) at an intersecting angle to said cylindrical casing head (4) encompassing the cap nut (10) on said one end

(22) of the pipe elbow (3) and a portion of said flexible inner pipe (1) connected thereto, and a portion of said surrounding flexible outer pipe (2).

18. A plumbing system according to claim 17, and clamp means on said casing neck (5*a*, 5*b*) engageable with said outer pipe (2) to fixedly clamp said outer pipe (2) thereto so it cannot slip out of said casing neck (5*a*, 5*b*).

19. A plumbing system according to claim 17, in which said casing neck (5*a*, 5*b*) is tubular and is composed of two mating half shells, and connecting means (15*a*/*b*, 16*a*/*b*, 17*a*/*b*, 18*a*/*b*) connecting said two half shells into the tubular shade.

20. A plumbing system according to claim 19, in which said means for detachably connecting (13*a*, 13*b*, 14) comprise plug type connectors extending between said half shell is (5*a*, 5*b*) and said casing head (4), whereby said casing neck (5*a*, 5*b*) can be manually attached without the aid of tools to said casing head (4).

21. A plumbing system according to claim 19, in which said connecting means include hinge means non-detachably connecting said two half shells (5*a*, 5*b*) together on one side.

22. A plumbing system according to claim 19, in which said connecting means include plug-in connecting means (51*a*, 51*b*) with at least two locking positions provided for joining said two half shells (46*a*, 46*b*) of said casing neck (45), wherein, in the first locking position, the cross section of the casing neck (45) is of adequate size to enable said casing neck (45) to be pushed over said outer pipe (2) and, in the second locking position, is of a size smaller than in said first locking position to clamp said outer pipe (2) in place thereto.

23. A plumbing system according to claim 22, including second connecting means (50*a*, 50*b*, 49) for attaching said casing neck (45) to said casing head (4) and being formed so that said casing neck (45) can be attached to said casing head (4) even if said plug-in connecting means (51*a*, 51*b*) have locked into the first locking position.

24. A plumbing system according to claim 17, in which said casing head (4) is provided with a thread (8) on its side open toward the front, and said locking ring (6) threadably connected to said thread (8) from the front to fix said pipe elbow (3) in said casing head (4).

25. A plumbing system according to claim 17, in which said casing head (4) has an interior wall, a rib-like projection (12) on said pipe elbow (3), at least one mounting on said interior wall which is engaged by said rib-like projection (12) so that twisting of the pipe elbow (3) during assembly is prevented.

26. A plumbing system according to claim 17, including a pincer-like clamping member (60) for the fixed clamping of said outer pipe on said casing neck (55) at the lower end facing away from said casing head (54).

27. A plumbing system according to claim 26, including a ribbed outer pipe, said clamping member (60) has, on the inside, at least two transverse ribs (64.1, 64.2) for fixedly connecting said ribbed outer pipe thereto, and a transition element (61) moveable in the manner of a hinge connecting said clamping member (60) to said casing neck (55).

28. A plumbing system according to claim 19, in which said casing neck (55) is designed to be flexible (59).

* * * * *